US008360021B2

(12) United States Patent
Toda et al.

(10) Patent No.: US 8,360,021 B2
(45) Date of Patent: Jan. 29, 2013

(54) VARIABLE VALVE GEAR FOR INTERNAL COMBUSTION ENGINE

(75) Inventors: Hitoshi Toda, Okazaki (JP); Masayuki Takagaki, Nukata-gun (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/614,794

(22) Filed: Nov. 9, 2009

(65) Prior Publication Data

US 2010/0116231 A1 May 13, 2010

(30) Foreign Application Priority Data

Nov. 12, 2008 (JP) ..... 2008-289810

(51) Int. Cl.
*F01L 1/34* (2006.01)

(52) U.S. Cl. ..... 123/90.17; 123/90.15; 123/346; 123/348

(58) Field of Classification Search ..... 123/90.15, 123/90.17, 346, 348
See application file for complete search history.

(56) References Cited

U.S. PATENT DOCUMENTS 6,230,675 B1 * 5/2001 Kobayashi et al. ..... 123/90.15

FOREIGN PATENT DOCUMENTS

| | | | |
|---|---|---|---|
| JP | 2006-300018 | A | 11/2006 |
| JP | 2006-312943 | A | 11/2006 |
| JP | 2007-231909 | A | 9/2007 |
| JP | 2008-115779 | A | 5/2008 |
| JP | 2008-261319 | A | 10/2008 |

OTHER PUBLICATIONS

Japanese Office Action issued in Japanese Patent Application No. 2008-289810 on Mar. 7, 2012.

* cited by examiner

*Primary Examiner* — Ching Chang
(74) *Attorney, Agent, or Firm* — Birch, Stewart, Kolasch & Birch, LLP

(57) ABSTRACT

Disclosed is a variable valve gear comprising a camshaft phase change mechanism, which variably controls a phase of an intake cam with respect to a crankshaft, and a variable valve lift mechanism, which changes an opening timing of an intake valve more than a closing timing and basically continuously varies a lift and an open period of the intake valve. The lift and the open period are set lest the intake valve interfere with a piston of an engine, with the phase controlled to be most advanced by the camshaft phase change mechanism and the lift controlled to be maximal by the variable valve lift mechanism.

5 Claims, 4 Drawing Sheets

VARIABLE VALVE GEAR FOR INTERNAL COMBUSTION ENGINE

BACKGROUND OF THE INVENTION

1. Field of the Invention

The present invention relates to a variable valve gear for an internal combustion engine, capable of changing the lift and the opening and closing timings of an intake valve.

2. Description of the Related Art

Conventionally, a variable valve lift mechanism for changing the lifts of intake and exhaust valves and a variable valve timing mechanism for changing the opening and closing timings (phases) of the valves are known as variable valve gears for internal combustion engines. An increasing number of modern internal combustion engines are equipped with both of these mechanisms in order to further improve the fuel efficiency and output performance.

In one such internal combustion engine provided with both the variable valve lift mechanism and the variable valve timing mechanism, a piston may interfere with the intake or exhaust valve near its top dead center when the lift or the opening and closing timings are considerably changed, if the two mechanisms are only combined.

Accordingly, a technique has been developed in which the operations of the variable valve lift and timing mechanisms are regulated lest the intake and exhaust valves interfere with the piston (Jpn. Pat. Appln. KOKAI Publication No. 2008-115779). According to this patent document, regulation means for regulating the change of the lift by the lift mechanism is provided in combination with regulation means for regulating the change of the valve-opening and closing timings by the timing mechanism. By these regulation means, the opening and closing timings are regulated based on the lift, or the lift is regulated based on the timings.

In the technique described in the above patent document, however, both the variable valve timing and lift mechanisms need to be each provided with the separate regulation means, so that the entire structure is complicated. If an attempt is made to continuously secure a high lift in accordance with the opening and closing timings, the variable valve timing and lift mechanisms should be cooperatively subjected to regulatory control. Thus, the control is inevitably complicated.

SUMMARY OF THE INVENTION

The object of the present invention is to provide a variable valve gear for an internal combustion engine provided with a variable valve timing mechanism and a variable valve lift mechanism, in which interference between an intake valve and a piston can be prevented by a simple structure and control.

In order to achieve the above object of the invention, there is provided a variable valve gear for an internal combustion engine, comprising a camshaft phase change mechanism, which variably controls a phase of an intake cam of the internal combustion engine with respect to a crankshaft, and a variable valve lift mechanism, which changes an opening timing of an intake valve more than a closing timing and basically continuously varies a lift and an open period of the intake valve, wherein the lift and the open period of the intake valve are set lest the intake valve interfere with a piston of the internal combustion engine, with the phase controlled to be most advanced by the camshaft phase change mechanism and the lift controlled to be maximal by the variable valve lift mechanism.

Thus, the variable valve lift mechanism changes the lift without substantially changing the valve-opening timing, so that the interference between the piston and the intake valve can be avoided by only setting the most advanced position of the phase by means of the camshaft phase change mechanism.

Therefore, the variable valve lift mechanism need not be provided with regulation means, and the variable valve lift mechanism and the camshaft phase change mechanism need not be regulated in cooperation with each other. Thus, in the internal combustion engine furnished with both these mechanisms, interference between the intake valve and the piston can be prevented by a simple structure and control.

Further, the variable valve lift mechanism can be powered to change the valve-open period even in the most advanced position of the camshaft phase change mechanism, so that the fuel efficiency can be improved.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

An Embodiment of the present invention will now be described with reference to the accompanying drawings.

Figure 1:
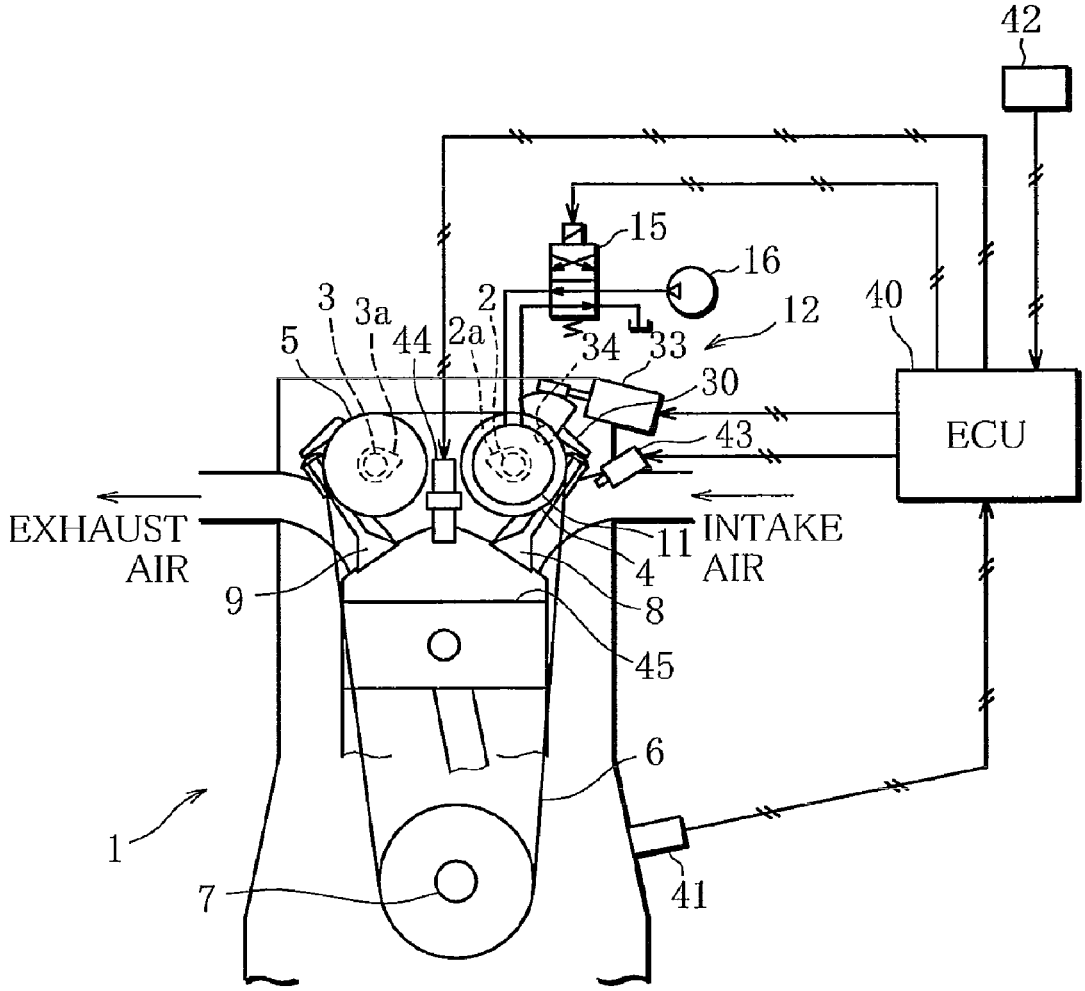
FIG. 1 is a schematic structure diagram of an engine provided with a variable valve gear according to an embodiment of the invention.

FIG. 1 is a schematic structure diagram of an internal combustion engine (hereinafter referred to as the engine) 1 provided with a variable valve gear of the present embodiment.

The engine 1 of the present embodiment includes a DOHC valve train and is mounted as a drive source in a vehicle. Timing pulleys 4 and 5 are connected, respectively, to the respective front ends of an intake camshaft 2 and an exhaust camshaft 3 of the engine 1. The pulleys 4 and 5 are coupled to a crankshaft 7 by a timing belt 6. As the crankshaft 7 rotates, the intake and exhaust camshafts 2 and 3 are rotated together with the pulleys 4 and 5. An intake valve 8 is opened and closed by driving an intake cam 2*a* on the intake camshaft 2, and an exhaust valve 9 by an exhaust cam 3*a* on the exhaust camshaft 3.

The variable valve gear of the present embodiment is used for the valve train that drives the intake valve 8. The variable valve gear is provided with a camshaft phase change mechanism 11 and a variable valve lift mechanism 12, which will be described hereinafter.

Figure 2:
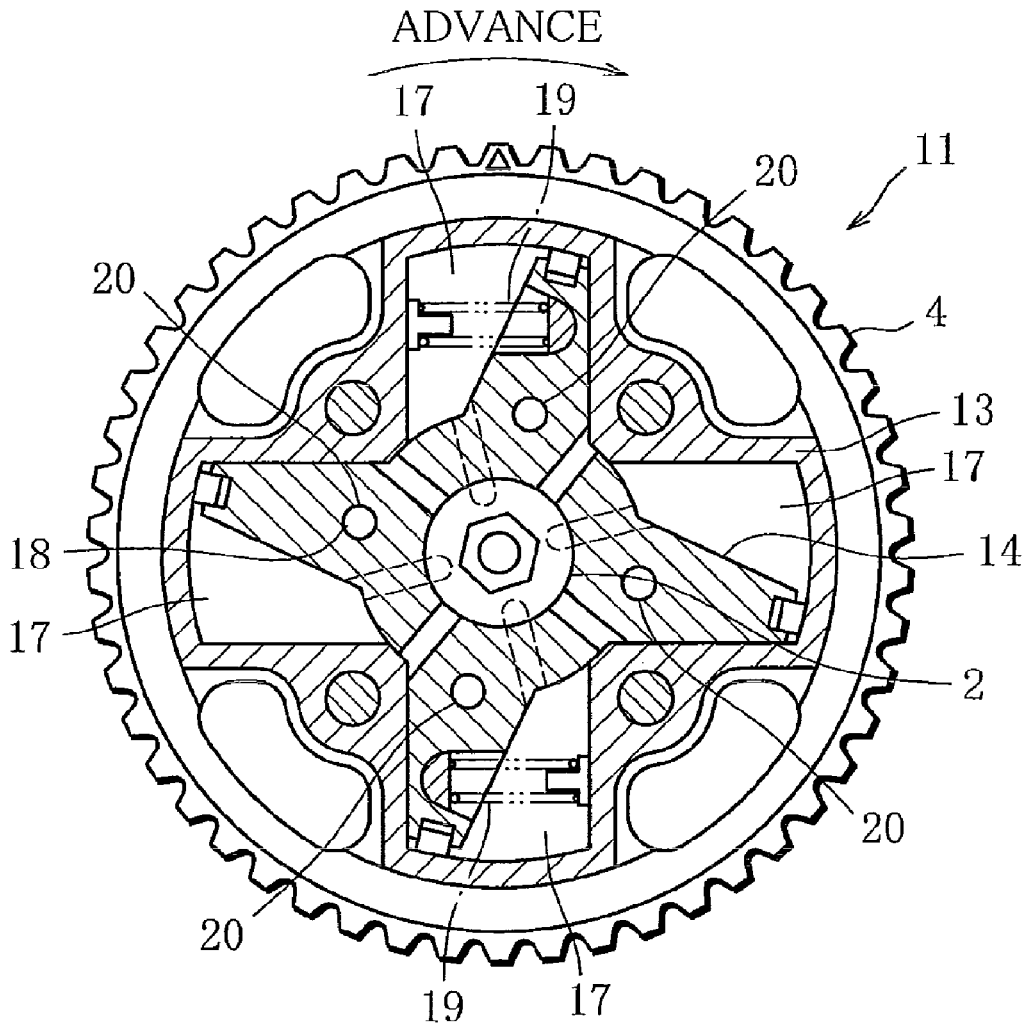
FIG. 2 is a structure view of a camshaft phase change mechanism.

FIG. 2 is an internal structure view of the camshaft phase change mechanism 11. The mechanism 11 will now be described with reference to FIGS. 1 and 2.

The camshaft phase change mechanism 11 is located between the intake camshaft 2 and the intake-side timing pulley 4. The mechanism 11 used may be a vane-type camshaft phase change mechanism, such as the one described in Jpn. Pat. Appln. KOKAI Publication No. 2000-27609 or Japanese Patent No. 3846605.

As shown in FIG. 2, the camshaft phase change mechanism 11 is constructed in such a manner that a vane rotor 14 is rotatably provided in a housing 13 in the timing pulley 4 and the intake camshaft 2 is coupled to the vane rotor 14.

An oil control valve (hereinafter referred to as the OCV) 15 is connected to the camshaft phase change mechanism 11 by an oil passage defined in the intake camshaft 2. A hydraulic fluid or oil supplied from an oil pump 16 of the engine 1 is fed into an oil chamber 17 defined between the vane rotor 14 and the housing 13 when the OCV 15 is switched, whereby the vane rotor 14 is rotated. Thereupon, the phase angle of the intake camshaft 2 with respect to the timing pulley 4, that is, the opening and closing timings of the intake valve 8, can be adjusted continuously.

Further, the camshaft phase change mechanism 11 is provided with a locking pin 18 and a spring (urging means) 19. The locking pin 18 is configured to be inserted into any of fitting holes 20 in the vane rotor 14, thereby preventing the rotor 14 from rotating. Thus, the most advanced position of the vane rotor 14 can be set. The spring 19 is located between the housing 13 and the vane rotor 14 and serves to urge the rotor 14 in an advance direction.

Figure 3:
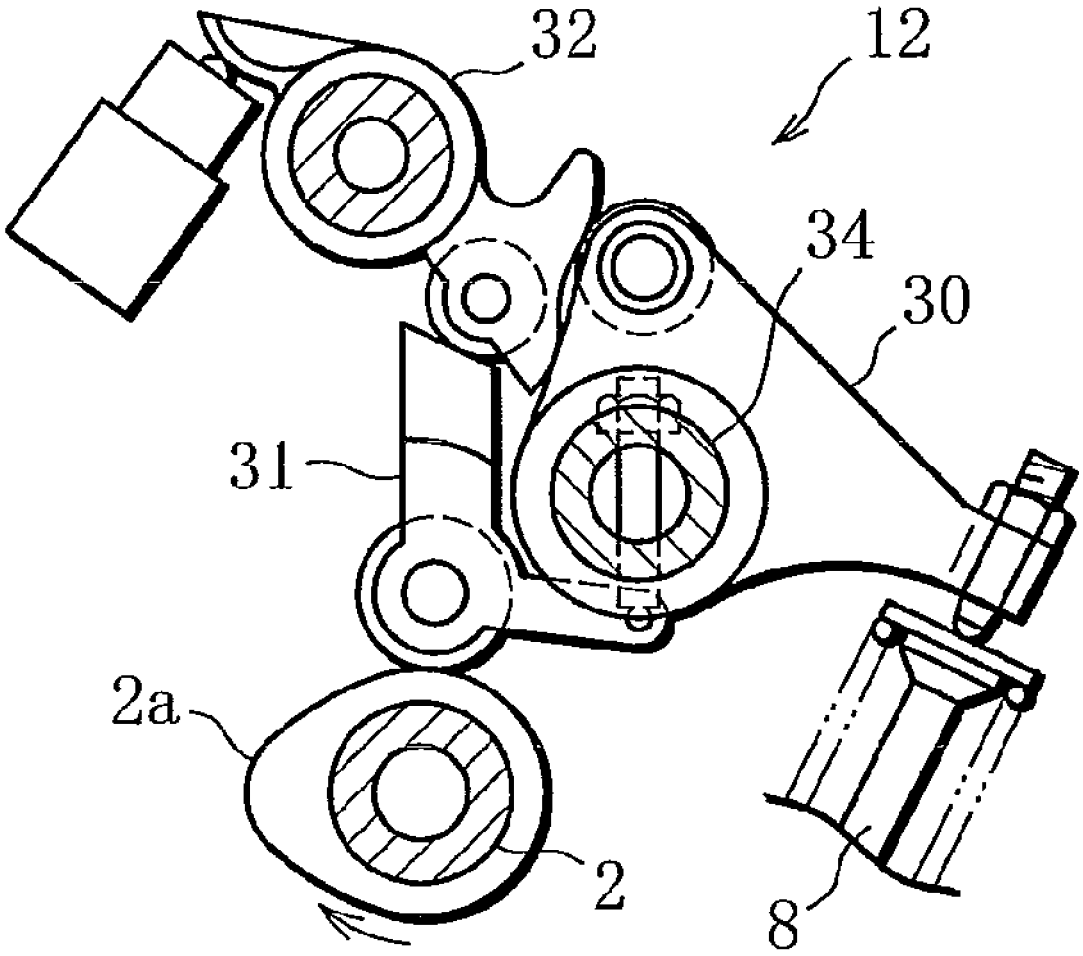
FIG. 3 is a structure view of a variable valve lift mechanism.

FIG. 3 is a schematic structure view of the variable valve lift mechanism 12. The structure of the mechanism 12 will now be described with reference to FIG. 3 in combination with FIG. 1.

The structure of the variable valve lift mechanism 12 is described in, for example, Jpn. Pat. Appln. KOKAI Publication No. 2005-299536. As shown in FIG. 3, a center rocker arm 31 and a swing cam 32 (a detailed description of which is omitted) are provided in addition to the intake camshaft 2 and a rocker arm 30 for driving the intake valve 8. In vertically moving the rocker arm 30 by rotating the intake camshaft 2, a rocker shaft 34 is driven by an electric motor 33 to move the pivotal position of the center rocker arm 31 so that a maximum lift of the intake valve 8 can be changed. Further, the valve-closing timing is advanced as the lift is reduced with the valve-opening Liming kept substantially constant, covering the range from the maximum to a minimum. Thus, the variable valve lift mechanism 12 is a single mechanism in which the intake camshaft 2 and the rocker arm 30 are combined with the center rocker arm 31 and the swing cam 32, and which serves to basically continuously vary the lift and an open period of the intake valve 8.

An ECU 40 is provided with an input-output device (not shown), storage devices such as ROM and RAM, central processing unit (CPU), timer counter, etc., and generally controls the engine 1.

Various sensors, such as a crank angle sensor 41 and a throttle sensor 42, are connected to the input side of the ECU 40. The crank angle sensor 41 detects the crank angle of the engine 1. The throttle sensor 42 detects the opening of a throttle valve (not shown). Further, a fuel injection valve 43, spark plug 44, etc., as well as the OCV 15 and the electric motor 33, are connected to the output side of the ECU 40. The ECU 40 determines the ignition timing, injection quantity, etc., based on detected information from the sensors, and drivingly controls the spark plug 44 and the fuel injection valve 43. Based on a preset map, moreover, the ECU 40 calculates the lift of the intake valve 8 and a target phase angle in accordance with an engine speed and the throttle angle, drives the electric motor 33 and the OCV 15, and performs control such that target values are reached by the actual lift and the phase angle.

Figure 4:
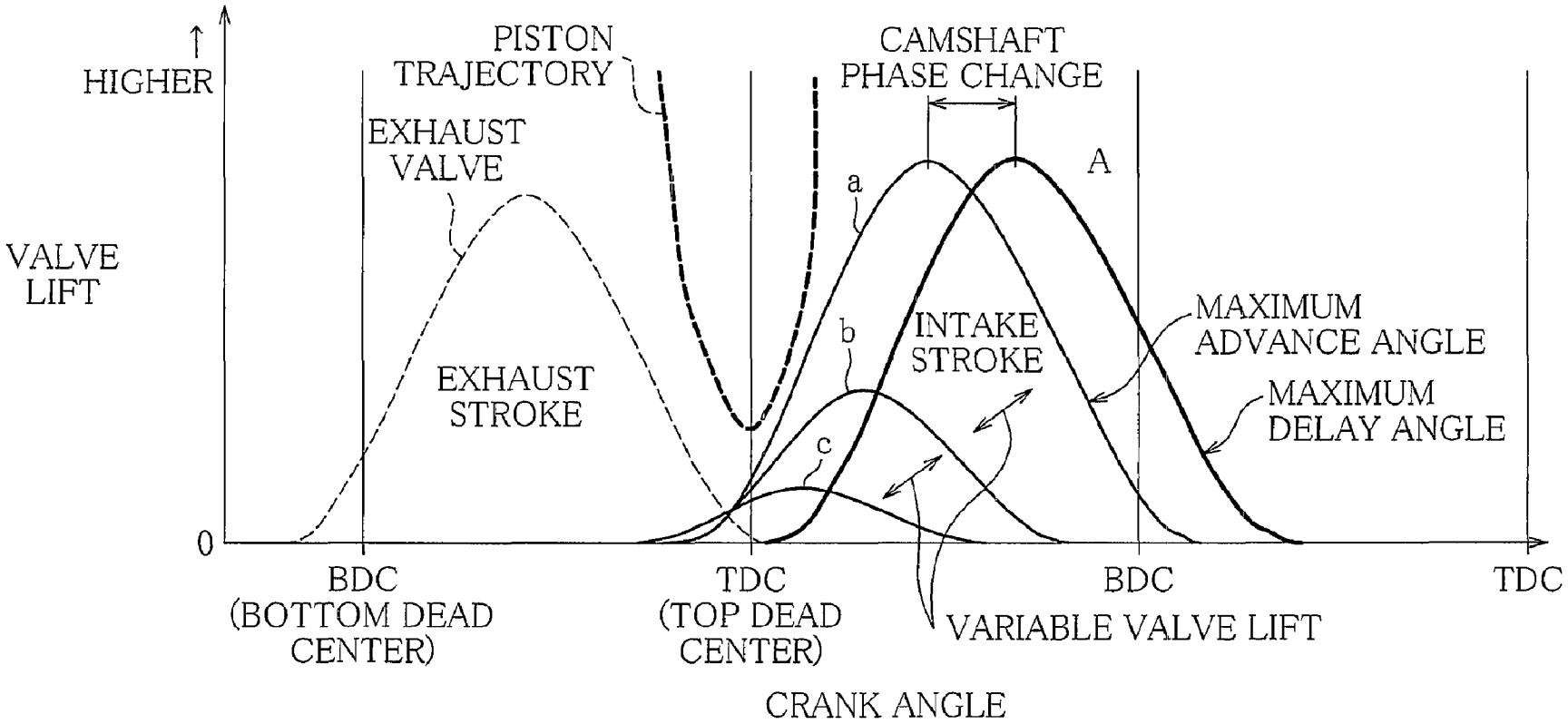
FIG. 4 is a graph showing the lift and lift timing of an intake valve.

FIG. 4 is a graph showing the lift and lift timing of the intake valve 8. FIG. 4 also shows a trajectory of the upper end of a piston 45 of the engine 1.

As mentioned before, the variable valve lift mechanism 12 has a property to basically continuously vary the open period and phase of the intake valve 8. As indicated by curves a, b and c, the valve-open period is reduced as the lift is reduced. The open period of the intake valve 8 is increased or reduced as the valve-closing timing is changed with the valve-opening timing kept substantially constant.

As indicated by curves a and A, on the other hand, the camshaft phase change mechanism 11 variously controls the phase in such a manner that the valve-opening and closing timings are slid without changing the lift and valve-open period.

Further, the locking pin 18 attached to the camshaft phase change mechanism 11 serves to hold a maximum advance angle of the opening timing of the intake valve 8 (holding means). If the lift of the intake valve 8 is controlled to be maximal, in particular, the most advanced position is set and regulated lest the intake valve 8 and the piston 45 interfere with each other (curve a). The regulated advanced position may be the most advanced position that can be reached on the camshaft phase change mechanism 11 or an extreme position that is held by the locking pin 18 and cannot be overreached without regard to the mechanism.

According to the engine 1 of the present embodiment, therefore, only the maximum advance angle of the camshaft phase change mechanism 11 is regulated, and interference with the piston 45 can securely be prevented even though the lift is changed by controlling the variable valve lift mechanism 12. Thus, according to the present embodiment, the camshaft phase change mechanism 11 is combined with the variable valve lift mechanism 12 that basically continuously varies the valve-open period and the phase. Accordingly, the variable valve lift mechanism 12 need neither be provided with separate regulation means nor subjected to regulatory control. In consequence, interference between the intake valve 8 and the piston 45 can be prevented by a simple structure and control.

Even if advance regulation is performed in the camshaft phase change mechanism 11, moreover, the valve-opening timing can be kept near the most advanced position without regard to the variation of the lift by the variable valve lift mechanism 12, so that the fuel efficiency can be prevented from being reduced. If the advance control is performed in the change mechanism 11, furthermore, the valve-closing timing can be changed together with the lift under the control of the lift mechanism 12. By delaying the closing timing of the intake valve 8 during high-load, high-speed operation, for example, the intake air filling efficiency is improved with the increase of the lift, so that the output performance can be improved. During low-load, low-speed operation, on the other hand, the fuel consumption performance can be improved by advancing the valve-closing timing.

Since the variable valve lift mechanism 12 is powered by an electric actuator, moreover, it can be accurately actuated even if the oil temperature is as low as in the case of a cold start or if the oil pressure is not sufficiently increased on account of the low-speed operation. Thus, the fuel efficiency for low-temperature, low-speed operation can be improved.

Since the engine output depends greatly on the lift of the valve, furthermore, the valve lift should be responsive to the operation of the accelerator, thus requiring electrification.

If the variable valve lift mechanism is used in place of the throttle valve to control the amount of air, in order to mitigate a pumping loss, in particular, it needs to have very high responsiveness to variation, so that the use of the electric actuator is advisable.

Since cooperative control with the phase change mechanism, if any, should be adjusted to a low-response hydraulic actuator, moreover, corrective control by the throttle valve is needed. Therefore, the pumping loss cannot be sufficiently mitigated, so that the fuel efficiency is reduced. Further, the cooperative control for the throttle valve, phase change, and lift change is so difficult that vibrations and deterioration of exhaust gas are caused by combustion fluctuations.

Furthermore, the camshaft phase change mechanism 11 is provided with the spring 19 for urging the rotor in the advance direction. Therefore, control on the advance side can be performed even if the oil temperature is as low as in the case of a cold start or if the oil pressure is not sufficiently increased on account of the low-speed operation. Also, the advance-side control can be performed even when the locking pin 18 does not operate.

What is claimed is:

1. A variable valve gear for an internal combustion engine, comprising:

a camshaft phase change mechanism which variably controls a phase of an intake cam of the internal combustion engine with respect to a crankshaft;

a variable valve lift mechanism which changes an opening timing of an intake valve more than a closing timing and basically continuously varies a lift and an open period of the intake valve;

wherein the camshaft phase change mechanism is provided with, a housing, a vane rotor rotatably attached to the housing and attached to an intake camshaft, holding means configured to limit rotation of the vane rotor with respect to the housing to hold the phase of the intake cam on the advance side, and an urging unit that urges the vane rotor in the advance side, and wherein the lift and the open period of the intake valve are set lest the lift at a top dead center interfere with a piston trajectory at the top dead center with the phase controlled to be most advanced by the camshaft phase change mechanism and the lift controlled to be maximal by the variable valve lift mechanism.

2. The variable valve gear for an internal combustion engine according to claim 1, wherein the camshaft phase change mechanism is powered by a hydraulic actuator, and the variable valve lift mechanism is powered by an electric actuator.

3. The variable valve gear for an internal combustion engine according to claim 1, wherein the holding means holds the phase of the intake cam on the advance side for low-temperature or low-speed operation of the engine.

4. The variable valve gear for an internal combustion engine according to claim 1, wherein the holding means is a locking pin supported by the vane rotor to limit rotation of the vane rotor with respect to the housing in the advance side.

5. The variable valve gear for an internal combustion engine according to claim 1, wherein the holding means is a locking pin supported by the vane rotor to limit rotation of the vane rotor with respect to the housing in the advance side.

* * * * *